United States Patent [19]

Heuckelbach et al.

[11] 4,425,944

[45] Jan. 17, 1984

[54] REPAIR PLUG FOR HEAT EXCHANGER TUBES, ESPECIALLY FOR STEAM GENERATORS OF PRESSURIZED-WEATHER NUCLEAR POWER PLANTS

[75] Inventors: Frederik E. Heuckelbach, Heinkenszand, Netherlands; Robert Weber, Uttenreuth; Jakob Weber, Erlangen, both of Fed. Rep. of Germany

[73] Assignee: Kraftwerk Union Aktiengesellschaft, Mülheim, Fed. Rep. of Germany

[21] Appl. No.: 320,869

[22] Filed: Nov. 13, 1981

[30] Foreign Application Priority Data

Nov. 17, 1980 [DE] Fed. Rep. of Germany ..... 3043343
Sep. 7, 1981 [DE] Fed. Rep. of Germany ..... 3135382

[51] Int. Cl.[3] ..... F16L 55/10; F16L 55/12

[52] U.S. Cl. ..... 138/89; 138/93; 165/76

[58] Field of Search ..... 122/361, 363; 138/89, 138/90, 91, 93; 165/76; 220/234, 235

[56] References Cited

U.S. PATENT DOCUMENTS

| | | | |
|---|---|---|---|
| 3,590,877 | 7/1971 | Leopold et al. | 138/89 |
| 3,724,062 | 4/1973 | Cantrell et al. | 138/89 X |
| 3,785,291 | 1/1974 | Bergbauer et al. | 138/89 X |
| 3,934,731 | 1/1976 | Müller et al. | 214/1 BB |
| 4,026,329 | 5/1977 | Thompson | 138/89 X |
| 4,069,573 | 1/1978 | Rogers, Jr. et al. | 29/421.3 |
| 4,349,047 | 9/1982 | Ditto et al. | 138/89 X |

FOREIGN PATENT DOCUMENTS 2709633 5/1977 Fed. Rep. of Germany .

*Primary Examiner*—Stephen Marcus
*Assistant Examiner*—Mark J. Thronson
*Attorney, Agent, or Firm*—Herbert L. Lerner; Laurence A. Greenberg

[57] ABSTRACT

Repair plug for sealing heat exchanger tubes, including a closure plug part being tightly connectable to a heat exchanger tube and having an end for insertion into the heat exchanger tube, and a polisher plug part disposed on the insertion end of the closure plug part axially in front of the insertion end in insertion direction thereof forming a single structural unit with the closure plug part, the polisher plug part remaining in the sealed heat exchanger tube after completing the tight connection.

4 Claims, 6 Drawing Figures

REPAIR PLUG FOR HEAT EXCHANGER TUBES, ESPECIALLY FOR STEAM GENERATORS OF PRESSURIZED-WEATHER NUCLEAR POWER PLANTS

The invention relates to a repair plug for heat exchanger tubes, especially for steam generators of pressurized-water nuclear power plants.

A repair plug of this type is known, for example, from U.S. Pat. No. 3,934,731 and German Published Prosecuted Application DE-AS 22 63 143, and specifically from FIG. 6 thereof. The repair plug is provided therein as an explosive plug. Prior to setting the explosive charge the heating tube surface of the steam generator heating tube involved must be scrubbed and cleansed, so that during the subsequent firing of the explosive charge a metallurgically flawless weld or blast welding between the explosive plug wall and the steam generator heating tube is produced. For this purpose a condenser tube brush (seen in FIG. 4 of German Application DE-AS No. 22 63 143) is used to strip any coarse impurities, such as an oxide coating from inside the heating tube involved; subsequently a cleansing finish with a polisher plug (FIG. 5 loc.cit.) results. Instead of explosive plugs, sleeve-like mechanically or hydraulically expandable closure plugs can also be used, as seen, for example, in British Pat. No. 1,258,369; there too, the problem encountered is that of scrubbing the inner surfaces of heat exchange tubes in the area of the spot to be sealed.

It is accordingly an object of the invention to provide a repair plug for heat exchanger tubes, especially for steam generators of pressurized-water nuclear power plants, which overcomes the hereinafore-mentioned disadvantages of the heretofore-known devices of this general type, and to maximally combine the preliminary operating steps for setting the closure plugs and in that way to reduce the working time for any present operating personnel. It is simultaneously an object to better meet the tightened requirements of radiological protection regulations.

With the foregoing and other objects in view there is provided, in accordance with the invention, a repair plug for sealing heat exchanger tubes, especially for steam generators of pressurized-water nuclear power plants, comprising a closure plug part being tightly connectible to a heat exchanger tube and having an end for insertion into the heat exchanger tube, and a polisher plug part disposed on the insertion end of the closure plug part axially in front of the insertion end in insertion direction thereof forming a single structural unit with the closure plug part, the polisher plug part remaining in the sealed heat exchanger tube after completing the tight connection.

In accordance with another feature of the invention, the insertion end of the closure plug part has a surface formed thereon, and the polisher plug part is in the form of a polisher disk packet, and including a clamping bolt, at least part of which is centrally disposed in the packet and anchored in the closing plug part holding or pressing the packet against the insertion end surface.

In accordance with a further feature of the invention, the disk packet is formed of individual polisher disks and the clamping bolt has a head, the head being conically tapered in the insertion direction and having a base with a diameter being smaller than the diameter of the disks.

In accordance with an added feature of the invention, the disk packet is formed of felt disks.

In accordance with an additional feature of the invention, there is provided a sleeve in which the clamping bolt is disposed, the felt disks being stacked on the sleeve and having central bores formed therein in which the sleeve is disposed.

In accordance with again another feature of the invention, the disk packet is formed of spring-loaded metal rings.

In accordance with again a further feature of the invention, the metal rings have piston ring-type slots formed therein, the slots formed in adjacent rings being mutually circumferentially offset.

In accordance with again an added feature of the invention, the clamping bolt includes a reinforced shaft having a reduced-diameter threaded extension screwed into the closure part, and the metal rings are seated with play on the reinforced shaft.

In accordance with again an additional feature of the invention, the clamping bolt has an insertion end surface having a recess formed therein for applying a socket-head cap-screw wrench.

In accordance with yet another feature of the invention, the clamping bolt has a head having a shoulder formed on the base thereof, and including a washer for supporting the polisher disk packet having substantially the same diameter as the shoulder and being disposed between the insertion end surface and the polisher disk packet.

In accordance with yet a further feature of the invention, the polisher disk packet is formed of individual plastic disks or rings.

In accordance with yet an added feature of the invention, the rings are stripping rings.

In accordance with yet an additional feature of the invention, the closure plug part is an explosive plug part.

In accordance with still a further feature of the invention, the closure plug part is a sleeve-like body having walls being expandable at least in given axial regions thereof, and including an axially traversable pressure chamber being disposed in the sleeve-like body and being loadable by fluid pressure medium for expanding the given wall regions.

In accordance with another feature of the invention, the closure plug part is a sleeve-like body having walls being expandable at least in given axial regions thereof, and including at least two pressure bodies being disposed in the sleeve-like body, contact pressure surfaces disposed in the sleeve-like body having peripheries being enlargeable through relative motion of the pressure bodies, and means disposed in the sleeve-like body for counter rotating the pressure bodies and enlarging the contact pressure surface peripheries relative to the inner periphery of the sleeve-like body.

In accordance with a further feature of the invention, there is provided a quasi-hydraulically operating contact pressure body on which the contact pressure surfaces are disposed, the quasi-hydraulically operating contact pressure body being formed of elastomeric plastic or elastoplastic and being compressible between the first-mentioned at least two pressure bodies.

In accordance with a concomitant feature of the invention, there is provided a sponge ball having a hardened surface and being mounted on the polisher plug part.

The advantages produced through the use of the invention primarily reside in the fact that both the cleansing-finish and tube-sealing operating stages are now combined in a single operating stage. When inserting the repair plug its polisher plug part takes over the cleansing-finish operation at the sealing spots so that because of the immediately following contact by the closure plug part with the cleansed surfaces through cold forming, a flawless metallic sealing joint of the closure plug part with the steam generator heating tube is assured.

Other features which are considered as characteristic for the invention are set forth in the appended claims.

Although the invention is illustrated and described herein as embodied in a repair plug for heat exchanger tubes, especially for steam generators of pressurized-water nuclear power plants, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
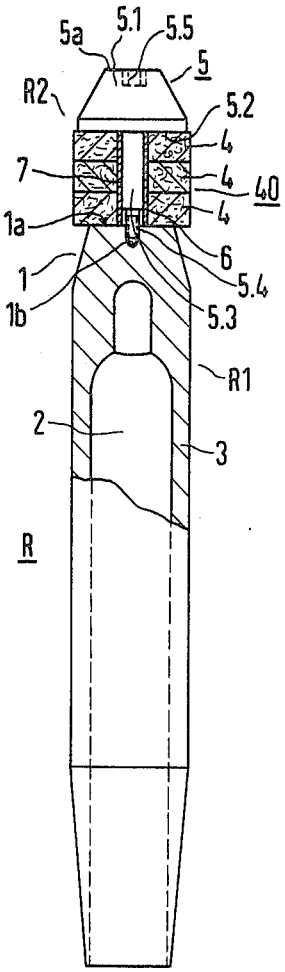
FIG. 1 is a simplified, diagrammatic, partially longitudinal-sectional and partially broken-away view of a first embodiment of a repair plug with an explosive plug part.

Referring now to the figures of the drawing and first particularly to FIG. 1 thereof, there is seen a repair plug R which is used for sealing heat exchanger tubes that have been damaged during their operation; their damage being verifiable by eddy current test means. For this purpose, as explained in German Published, Prosecuted Application DE-AS No. 22 63 143, an eddy current probe is inserted in the individual heat exchanger tubes. By means of a distortion of eddy current probe signals, which are displayed, for example, on the luminescent screen of a cathode ray oscilloscope, verification can be obtained as to whether or not the just-inspected heat exchanger tube has any minor surface cracks, hairline cracks or leads. Specifically, this involves heating tubes for steam generators used in pressurized-water nuclear power plants, which must be subjected to periodic eddy current examinations. However, this can basically involve a general type of heat exchanger tube. The defective tube must be deadlocked or effectively sealed-off in order to prevent any primary medium from getting through the wall of the heating tube into the secondary chamber of the steam generator and therefore into the secondary loop. Accordingly, to seal off the heating tubes, which have been detected as being defective, the repair plug R according to FIG. 1 is used. The repair plug R includes an explosive plug part R1, and a polisher plug part R2 axially connected ahead of an inserting end 1 thereof. The two plug components R1 and R2, as shown, form an integral unit, so that following the completion of the explosive joint the polisher plug part R2 remains in the heating tube being sealed thereby. The explosive plug part R1 has a cavity 2 formed therein and a plug wall 3. In this cavity, a non-illustrated explosive charge and fuse are deposited, and the detonator cables are led out to an operators deck by means of a pushing or feeding tube. The repair plug R has already been transferred through a remotely-controlled hollow transporter tube to the mouth of the heating tube involved by means of the feeding tube. The setting of the repair plug R is done by means of manipulators. Following the setting of the repair plug R, an appropriate manipulator swivel arm is swiveled out of range of the explosion wave together with the transporter and tubes.

The polisher plug part R2 is formed by a felt disk packet 40 including three felt disks 4, the packet 40 being held by centric through-clamping bolt 5 against a frontal planar face 1*a* of the explosive plug part R1. The clamping bolt 5 has the bolt head 5.1 thereof conically tapered in the direction of insertion, the conical base 5.2 thereof having a diameter which is only a little smaller than that of the felt disks 4. Each felt disk 4 is forced onto a sleeve 7 through a central bore 6. The clamping bolt 5 has a shaft 5.3 which is placed through this sleeve 7 and a thread 5.4 on the end thereof that is screwed into a matching tapped hole 1*b* of the insert end 1. In order to be able to apply a wrench used for sockethead cap screws, the inserting side face 5*a* of the clamping bolt 5 can be equipped with a matching hexagon-shaped recess 5.5 therein. The conical taper of the clamp bolt head 5.1 serves for centering the repair plug R when inserting the latter into the heating tube involved, and in that way to facilitate the insertion therein. The felt disks 4 have an excellent scrubbing effect; it has been found to be completely safe to leave them remaining in the tube.

Figure 2:
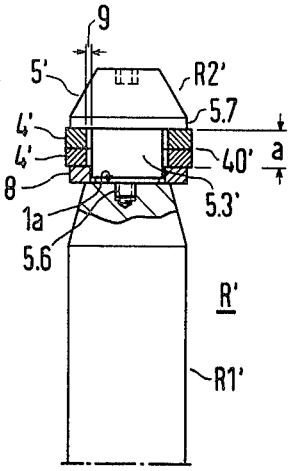
FIG. 2 is another partially broken-away fragmentary view similar to FIG. 1, of an embodiment variant with spring-loaded metal rings instead of felt disks on the polisher plug part.
Figure 3:
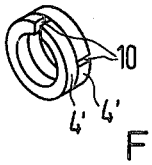
FIG. 3 is a perspective view of a slotted metal ring embodiment.

According to FIG. 2, a polisher disk packet 40' including springloaded metal rings 4', is provided. These metal rings 4' are seated with some play on a reinforced shaft 5.3' of a clamping bolt 5'. The front face of the shaft 5.3' is provided with a threaded extension 5.6 having a reduced diameter as compared to the shaft for screwing in the explosive plug part R1. A washer 8 is disposed between the ring packet 40' and the face 1*a* to additionally support the ring packet 40' (the outer diameter of the washer being approximately equal to that of the bolt head shoulder 5.7), so that the metal rings 4' have a spring-loaded support limiting radial motion between the bolt head shoulder 5.7 and the washer 8. Contributing to this effect, there is on the other hand a certain degree of play through the distance 9 between the internal periphery of the metal rings and the external periphery of the shaft 5.3', and on the other hand there is a spacing "a" between the bolt head shoulder 5.7 and the washer 8. This spacing "a" is dimensioned in such a way that minor axial play for the metal rings remains. The rings are made so as to be spring loaded, which can be accomplished by providing an appropriate type of slotting, which is not shown in FIG. 2. Of special advantage in this context is a type of metal ring 4', as is shown diagrammatically in the perspective view of FIG. 3, which is slotted in a manner similar to a piston ring, wherein the slots 10 of the adjacent metal rings 4' are offset against each other in the circumferential direction. More than two piston rings or metal rings can also be disposed on the polisher plug part. This is also applicable to the felt disks in the embodiment according to FIG. 1.

The washer 8 according to FIG. 2 could also be effectively used in the first embodiment according to FIG. 1. Furthermore, instead of the disk-shaped metal rings 4' according to FIGS. 2 and 3, plastic rings having a scraper or slip ring construction type, for example, can be used, especially with heat exchangers used under lower operating temperature conditions.

Figure 4:
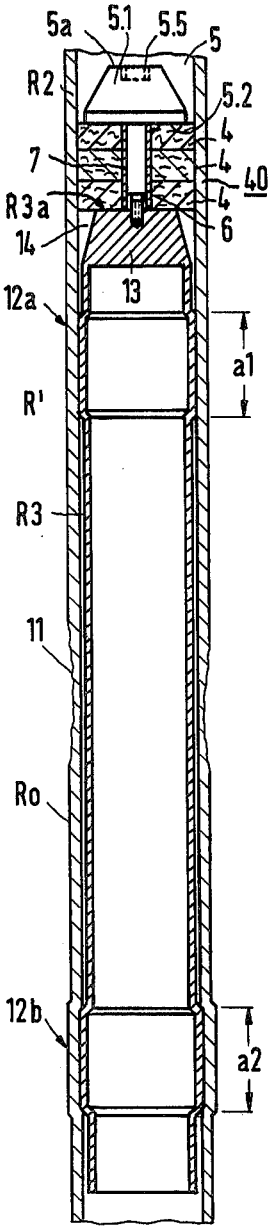
FIG. 4 is a fragmentary, partially longitudinal-sectional view of a repair plug having a closure plug part, which is constructed as a mechanically or hydraulically expandable sleeve-like body.

FIG. 4 shows an axial section taken through the polisher plug part R2 according to FIG. 1, the part R2 being disposed on a sleeve-like body R3, which functions as sealing plug part and is of a hydraulically or mechanically expandable type. In FIG. 4 there is seen to tube Ro, into which the repair plug R' is to be inserted. The tube Ro is, for example, the heat exchanging tube of a steam generator for nuclear power plants, which has undergone a cross-sectional weakening at the point 11 by an external attack of material corrosion. The repair plug R', as shown, is applied at this locational and dimensional detection of this defect by means of an eddy current probe unit, so that the defect can be isolated by two sealing joints 12*a* and 12*b* at the polisher plug end of the body R3 and at the opposite end thereof, respectively. Therefore, in case the defect 11 springs a leak then no primary medium from the interior of the tube Ro can penetrate into the secondary loop (the exterior of the tube Ro). The body R3 is formed of a cold-workable or formable corrosion resistant steel, such as of the Inconel 600-alloy type; it includes the frusto-conically reinforced head part 13, on which the polisher plug part R2 according to FIG. 1 is mounted. The head part 13 can be formed onto the body R3, i.e., it can be trued up to gauge and in any given case made to scale by turning or grinding means. However, the head part 13 also can be welded together with the remaining part of the body R3. The reference symbol 12*a* illustrates the point of the first expander stage of the body R3 where the outer wall of the sleeve-like body R3 is widened in its axial region al to such a degree that it abuts the internal circumference of the tube Ro. In a second expander stage the body R3 in the axial region a2 is bent so far outward that the tube Ro enveloping the body R3 has also been concentrically widened along with it, and protrudes in the shape of an annular ring or bulge. It is only with this second cold-forming stage that the required leakproofing of the sealing joint of the body R3 and the tube Ro, is accomplished. Pockets 14 formed as a result of the conical construction of the head part 13, the internal periphery of the tube Ro, and the bottom felt disk 4, can be used for the pickup of large size stripped dirt particles.

Figure 5:
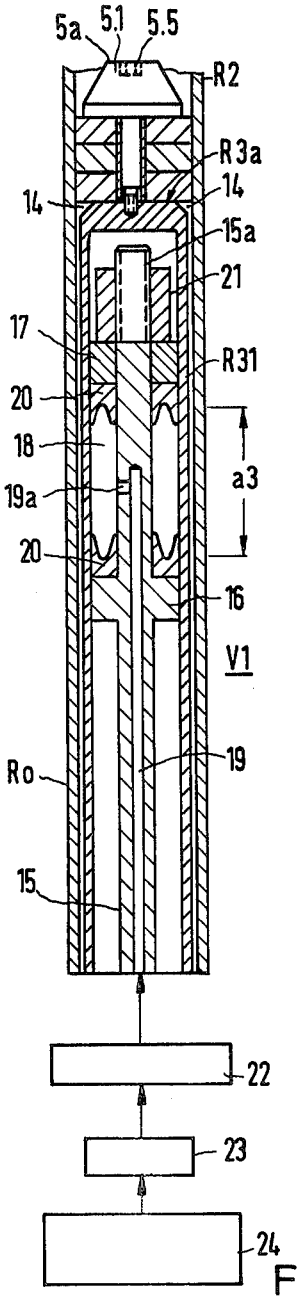
FIG. 5 is a somewhat modified view of the repair plug according to FIG. 4, having a hydraulic expander device, including a schematic block diagram.
Figure 6:
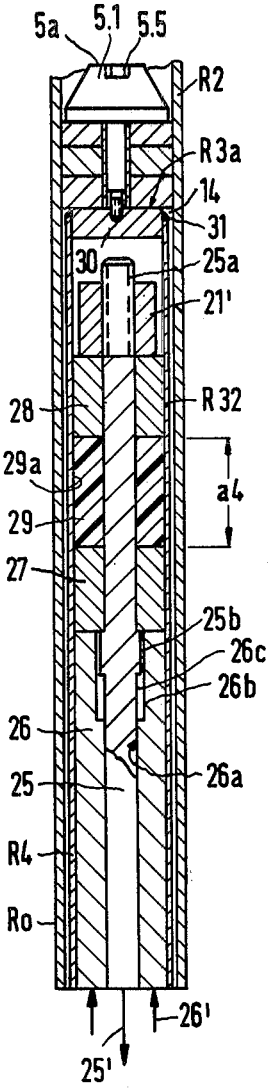
FIG. 6 is a view of a further modification of the repair plug according to FIG. 4, having a mechanical expander device.

While FIG. 4 shows that quite generally the polisher plug part R2 according to FIG. 1 and also according to FIG. 2 can be associated with any sleeve-like body R3, which can be widened by mechanical or hydraulic means for producing the sealing joint, FIGS. 5 and 6 show a special type of widener device, namely a hydraulic device in FIG. 5, and a mechanical device in FIG. 6.

Also according to FIG. 5, the polisher plug part R2 is mounted on the mating front face R3*a* of the closure plug part in the same way as in FIG. 4, the closure plug part being designated here with reference symbol R31. By comparison with FIG. 4, the head part 13 has a somewhat shorter shape but is equally conically pointed, so that the pockets 14 are again produced. The associated hydraulic widener device is designated overall with reference symbol V1, and has an axially traversable, hollow-drilled mandrel 15 equipped with an axially-fixed flange 16. The outer periphery of the flange 16 exactly matches the internal periphery of the sleeve-like body R31, which serves as a closure plug part. The mandrel 15 is equipped with a flange 17 being axially traversable thereon; the flange 17 being seated with a tight fit both on the shaft of the mandrel 15 and within the body R31. Interposed between the flanges 16 and 17 is a hydraulic pressure chamber 18, which communicates with an axial bore 19 through a cross-hole channel 19*a*. Within the pressure chamber 18, on both of the ends thereof, a sealing body 20 is respectively disposed. Each body effectively seals off the mandrel shaft and is also tightly applied to the internal periphery of the body R31. The sealing effect increases upon any hydraulic pressure increase because both U-shaped legs of the ring-shaped sealing bodies expand as a function of the pressure thereon. A nut 21 is seated on the free threaded end 15*a* of the mandrel 15, through which the traversable flange 17 can be axially adjusted within given limits, so that the axial length of the pressure chamber 18 is also adjustable. As indicated by arrows and blocks in FIG. 5, the inner channel 19, 19*a* is connected to a hydraulic system including a control unit 22, a pump 23, and a hydraulic accumulator 24. By means of the hydraulic control system the hydraulic fluid pressure in the pressure chamber 18 can be controlled with respect to its rise, drop, and effective timing. To produce a deformation according to the point 12*a* in the axial region al of FIG. 4, a pressure of approximately 410 to 490 bar is required; for a widening effect such as is shown at point 12*b* of the axial region a2, the hydraulic pressures used range from about 950 to 1050 bar. More details, which are of no relevance here, can be inferred, such as from the U.S. Pat. No. 4,069,573, and the German Published, Prosecuted Application DE-AS 27 09 633.

A final embodiment illustrated in FIG. 6, in which identical parts again carry identical reference symbols, shows that the polisher plug part R2 can be combined with the sleeve-like body R32 being used as a closure plug part; the walls of the body R32 being axially expandable, at least in partial axial regions, such as the region a4. For this purpose, the interior of the sleeve-like body R32 is provided with means 25, 26, 25*a*, 21' for the counter-rotating motion of at least two pressure bodies 27, 28. Because of the relative motion of these bodies 27, 28, the outer periphery of the contact pressure faces 29*a* can be expanded relative to the inner periphery of the sleeve-like body R32. In the illustrated embodiment the contact pressure faces 29*a* are disposed on a quasi-hydraulic contact pressure body 29, the body preferably being formed of an elastoplastic, and being compressible between the pressure bodies 27, 28. Element 25, as indicated by the downward-pointing arrow 25', is a drawbar, on the free upper end of which a nut 21' being of an axially-limited adjustment type, is screwed onto a thread 25*a*. In this way the pressure body 28 can be pulled in the direction of the arrow 25' against the contact pressure body 29. The abutment of the body 29 is formed by the second pressure body 27 together with a hollow pressure bar 26, in a central bore 26*a* of which the drawbar 25 is axially traversable. The force effect on the pressure bar 26 is illustrated by the upward-pointing arrows 26'. Any further details for the dimensioning of the heat exchanger tube Ro and the widening device according to FIG. 6 as well as for the magnitude of the forces, which are of no immediate relevance here, can be inferred from the above-cited U.S. Pat. No. 4,069,573, and the German Published, Prosecuted Application DE-AS 27 09 633, to which specific reference is made in this connection.

In the embodiment according to FIG. 6, the polisher plug part R2 is mounted on a face plate 30, which is inserted with a tight fit into an upper opening of the sleeve-like body R32 and is welded therein by means of a circular welding seam 31. Reference numeral 14 again designates the pockets produced by the conical shaped of the plate 30 or the welding seam 31, respectively. A reinforced shaft part 25*b* of the drawbar 25 and a shoulder formed by the deeper recess 26*c* of the pressure bar 26, the shoulder serving as the limit stop for the reinforced shaft part 25*b* of the drawbar 25, together in effect put limit on the expansion of the contact pressure body 29.

It is obvious that by means of the repair plug according to the invention for the setting of sealing sleeves disposed in heat exchange tubes, whether it be in the form of explosive plugs or hydraulically or mechanically expanded sleeves, the required scrubbing on the inner periphery of the heat exchanger tube sections involved in a single stage is always assured in such a way that the scrubbed faces can be put in metallic contact with the outer surfaces of the closure plug immediately after their purification. Thus, on one hand operating stages can be dispersed with, and on the other hand the quality of the cold-forming joint produced is improved.

The scope of the invention also covers the type of repair plug having a sponge ball with a hardened surface mounted on its polisher plug part to serve as the polishing body. Non-illustrated sponge balls such as these are also known as Taprogge balls.

There are claimed:

1. Repair plug for sealing heat exchanger tubes, comprising a closure plug part being tightly connectable to a heat exchanger tube and having an end for insertion into the heat exchanger tube, and a polisher plug part disposed on said insertion end of said closure plug part axially in front of said insertion end in insertion direction thereof forming a single structural unit with said closure plug part, said polisher plug part remaining in the sealed heat exchanger tube after completing the tight connection, said insertion end of said closure plug part having a surface formed thereon, and said polisher plug part being in the form of a felt polisher disk packet, a clamping bolt, at least part of which being centrally disposed in said packet and anchored in said closure plug part holding said packet against said insertion end surface, and a sleeve in which said clamping bolt is disposed, said felt disks being stacked on said sleeve and having central bores formed therein in which said sleeve is disposed.

2. Repair plug according to claim 1, wherein said disk packet is formed of individual polisher disks and said clamping bolt has a head, said head being conically tapered in the insertion direction and having a base with a diameter being smaller than the diameter of said disks.

3. Repair plug for sealing heat exchanger tubes, comprising a closure plug part being tightly connectable to a heat exchanger tube and having an end for insertion into the heat exchanger tube, and a polisher plug part disposed on said insertion end of said closure plug part axially in front of said insertion end in insertion direction thereof forming a single structural unit with said closure plug part, said polisher plug part remaining in the sealed heat exchanger tube after completing the tight connection, said insertion end of said closure plug part having a surface formed thereon, and said polisher plug part being in the form of a felt polisher disk packet, and a clamping bolt, at least part of which being centrally disposed in said packet and anchored in said closure plug part holding said packet against said insertion end surface, said clamping bolt having an insertion end surface having a recess formed therein for applying a socket-head cap-screw wrench.

4. Repair plug according to claim 1 or 3, wherein said closure plug part is an explosive plug part.

* * * * *